US005430803A

United States Patent [19]

Kimura et al.

[11] Patent Number: 5,430,803

[45] Date of Patent: Jul. 4, 1995

[54] BIFUNCTIONAL EARPHONE SET

[75] Inventors: Hirofumi Kimura; Masakiyo Ohsako, both of Tokyo, Japan

[73] Assignee: Soei Electric Co., Ltd., Tokyo, Japan

[21] Appl. No.: 33,031

[22] Filed: Mar. 19, 1993

[51] Int. Cl.[6] ..... H04R 25/00

[52] U.S. Cl. ..... 381/187; 381/190

[58] Field of Search ..... 381/187, 183, 25, 173, 381/190, 194, 195, 68.6; 181/128, 129

[56] References Cited

U.S. PATENT DOCUMENTS

| | | | |
|---|---|---|---|
| 2,493,734 | 1/1950 | Pearson | 381/187 |
| 3,324,253 | 6/1967 | Uemura et al. | 381/187 |
| 3,781,492 | 12/1973 | Cragg et al. | 379/430 |
| 4,025,734 | 5/1977 | Aloupis | 381/151 |
| 4,132,861 | 1/1979 | Frieder, Jr. et al. | 381/195 |
| 4,150,262 | 4/1979 | Ono | 381/68.6 |
| 4,418,248 | 11/1983 | Mathis | 381/190 |

FOREIGN PATENT DOCUMENTS

| | | | |
|---|---|---|---|
| 0012822 | 1/1977 | Japan | 381/197 |
| 0103599 | 8/1981 | Japan | 381/190 |
| 0149900 | 11/1981 | Japan | 381/190 |
| 0065092 | 4/1982 | Japan | 381/173 |
| 0081799 | 5/1982 | Japan | 381/190 |

*Primary Examiner*—Curtis Kuntz
*Assistant Examiner*—Huyen D. Le
*Attorney, Agent, or Firm*—Martin Sachs

[57] ABSTRACT

In construction of an earphone set incorporating a vibratory membrane accompanied with a ceramic wafer, a coactive magnetic electroacoustic conversion is arranged facing the vibratory membrane in a manner such that the vibratory membrane reproduces human voices on receipt of corresponding electric acoustic signals whereas the conversion unit issues electric acoustic signals on collection of corresponding human voices at the vibratory membrane.

3 Claims, 3 Drawing Sheets

BIFUNCTIONAL EARPHONE SET

BACKGROUND OF THE INVENTION

The present invention relates to a bifunctional earphone set, and more particularly relates to a compact earphone set which functions as a microphone as well as a receiver used for electroacoustic treatment of human voices.

Generally in the field of electroacoustic treatment of human voices, voices are collected directly from a human mouth using an electric pickup such as a microphone. In the case of this voice collection, however, the microphone is liable to pick up unnecessary ambient sounds in addition to human voices to be collected and mixing of such ambient sounds causes generation of harsh noises in voice reproduction.

In order to cut off such ambient sounds, it was proposed by the inventor in his earlier Japanese application Hei. 3-240194 to collect human voices through vibrations of the tympanic membrane of a speaker at generation of voices. That is, vibrations of the tympanic membrane is sensed by a compact ear set provided with a built-in pickup such as a microphone. Collection of voices within the ear of the speaker only well excludes mixing of ambient sounds.

In the case of this prior invention, the compact ear set functions as a microphone. However, a separate receiver has to be prepared for reception and electroacoustic conversion of transmitted electric signals which carry acoustic information.

SUMMARY OF THE INVENTION

It is thus the primary object of the present invention to provide a compact earphone set which functions as a microphone as well as a receiver.

In accordance with the basic aspect of the present invention, an earphone set includes, within a housing, a piezoelectric vibration unit and a coactive magnetic electroacoustic conversion unit arranged facing the vibration unit in a manner such that the vibration unit reproduces human voices on receipt of corresponding acoustic signals at the conversion unit and the conversion unit issues electric acoustic signals on collection of corresponding human voices at the vibration unit.

DESCRIPTION OF THE PREFERRED EMBODIMENTS

Figure 1:
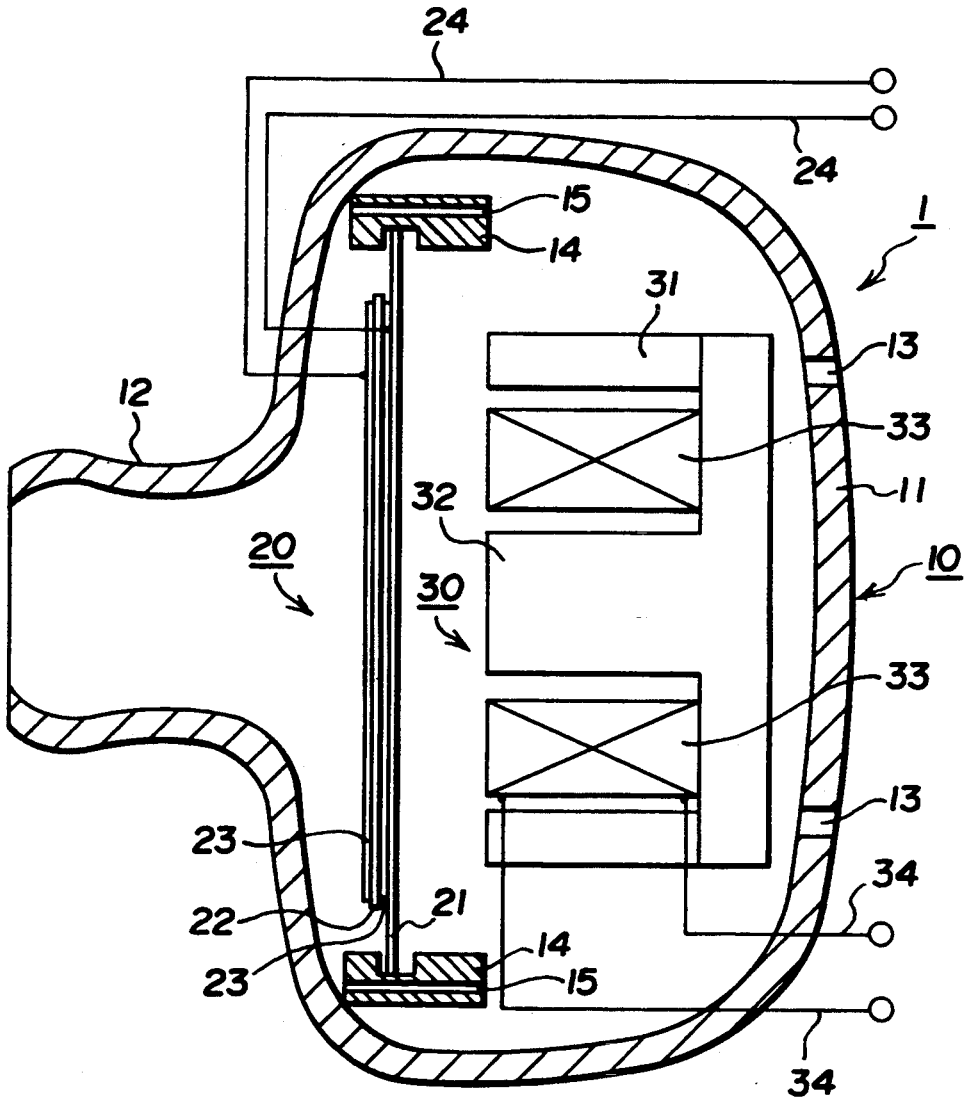
FIG. 1 is a side view, partly in section, of the first embodiment of the earphone set in accordance with the present invention.

The first embodiment of the earphone set in accordance with the present invention is shown in FIG. 1 in which the above-described magnetic electroacoustic conversion unit includes one set of coil only.

More specifically in FIG. 1, an earphone set 1 includes a small, pan-shaped housing 10 made up of a main body 11 and an ear socket 12 projecting from one planar end of the main body 11. One or more air holes

13 are formed through the wall of the main body 11 in order to prevent undesirable resonance of human voices introduced into the main body 11 through the ear socket 12. Support brackets 14 are arranged within the main body 11 near the ear socket 12 in order to hold the piezoelectric vibration unit 20 while allowing free vibration of the latter. At least one air hole 15 is formed through each support bracket 14 again for prevention of human voice resonance.

Figure 3:
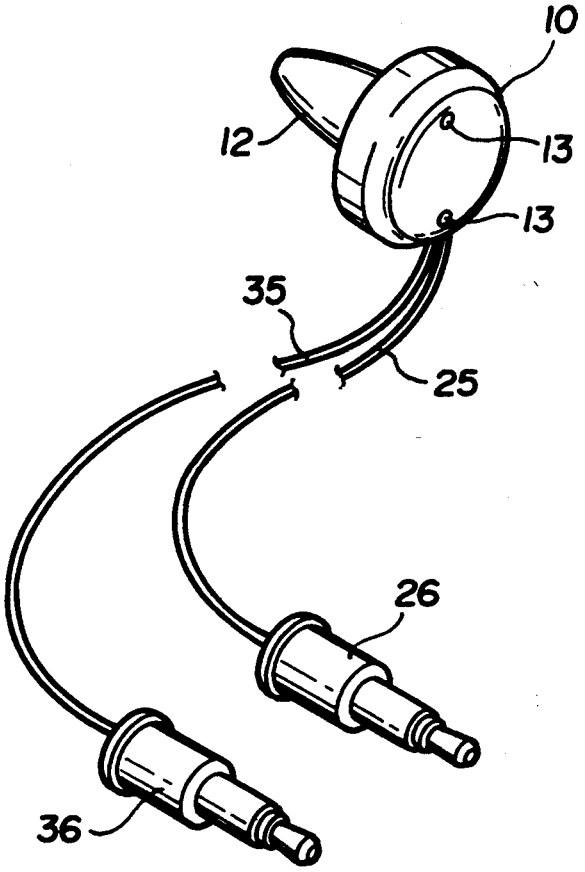
FIG. 3 is a perspective view of the earphone set incorporating the present invention.

The piezoelectric vibration unit 21 includes a vibratory membrane 21 held by the support bracket 14 at a position facing the ear socket 12 of the housing 10. A ceramic wafer 22 is boned to the vibratory membrane 21 on a side facing the ear socket 12. This ceramic wafer 21 is sandwiched by a pair of conductor films 23 which form different poles of the ceramic wafer 22. The conductor films 23 are accompanied with leads 24, respectively, which are bundled together to form a cord 25. As shown in FIG. 3, the cord 25 extends outside the housing 10 for connection to a terminal 26.

A magnetic, electroacoustic conversion unit 80 is arranged facing the vibratory membrane 21 of the vibration unit 20 at a position remote from the ear socket 12. The electroacoustic conversion unit 30 includes a permanent magnet 31 and an iron core 32 arranged within the magnetic field of the permanent magnet 31 and a coil 33 is wound about the iron core 32. The coil 33 is accompanied with leads 34 which are bundled together to form a cord 35. As shown in FIG. 3, the cord 35 extends outside the housing 10 for connection to a terminal 36.

The earphone set of the above-described construction operates in two fashions as follows.

First, the earphone set 1 operates as a microphone, when human voices are introduced into the housing 10 via the air socket 12, the vibratory membrane 21 of the vibration unit 20 is driven for corresponding vibrations which apply pressure to the ceramic wafer 22. Depending on change in intensity of the applied pressure, the ceramic wafer 22 generates electric acoustic signals of correspondingly varying voltages. The electric acoustic signals are then transmitted to a proper outside sound system via the cord 25 and the terminal 26.

Next, the earphone set 1 operates as a receiver. In this case, electric acoustic signals are transmitted to the conversion unit 30 from a proper outside system via the terminal 36 and the cord 35. On receipt of the electric acoustic signals. The coil 33 varies magnetic fluxed in the iron core 32 to cause corresponding change in the magnetic field. Depending on the change in the magnetic field, the vibratory membrane 21 of the vibration unit 20 vibrates at frequencies corresponding to change in the magnetic field to generate voices corresponding to the electric acoustic signals received at the conversion unit 30.

Figure 2:
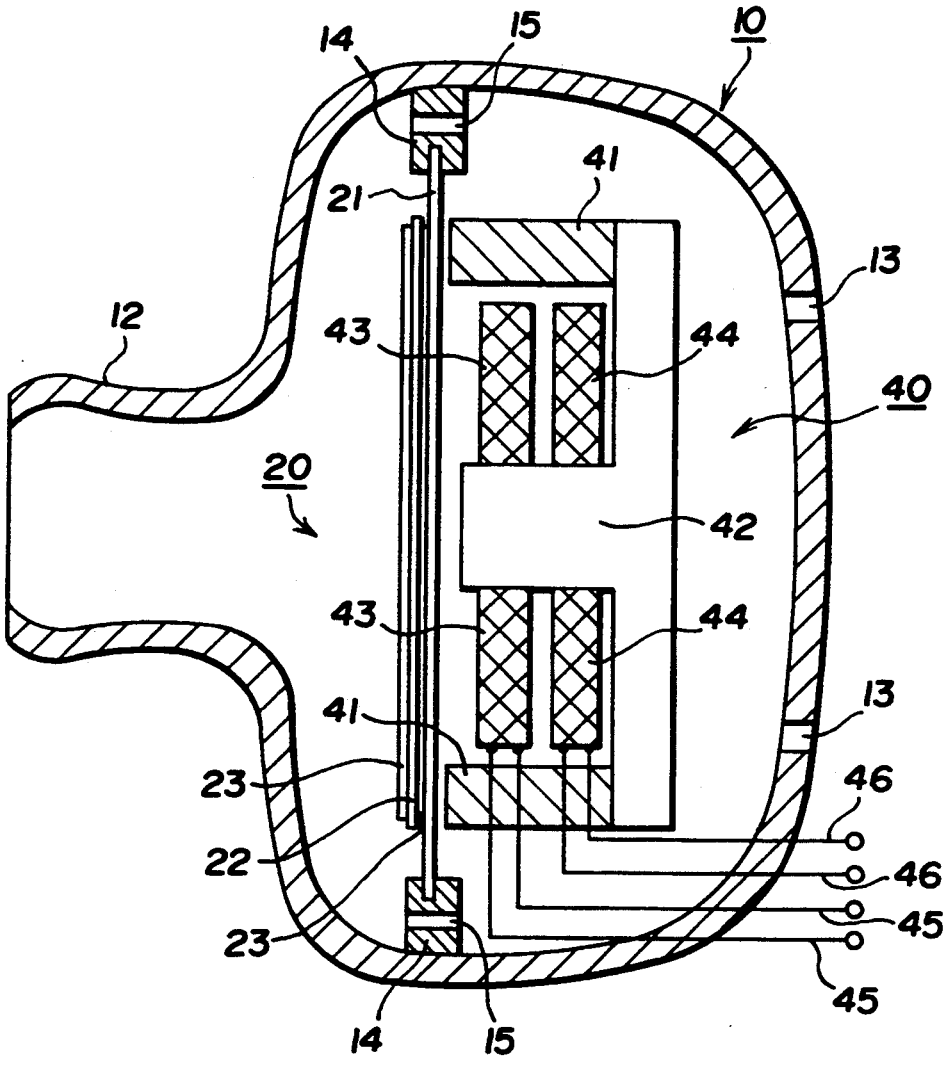
FIG. 2 is a side view, partly in section, of the second embodiment of the earphone set in accordance with the present invention.

The second embodiment of the earphone set in accordance with the present invention is shown in FIG. 2 in which the magnetic electroacoustic conversion unit includes two sets of coils. In this case, the constructions of the housing 10 and the piezoelectric vibration unit 20 are substantially same as those in the first embodiment.

Like the first embodiment, a magnetic, electroacoustic conversion unit 40 is arranged facing the vibratory membrane 21 of the vibration unit 20 at position remote from the ear socket 12. The electroacoustic conversion unit 40 includes a permanent magnet 41 and an iron core 42 arranged within the magnetic field of the permanent magnet 41 and a pair of coils 43 and 44 are coaxially wound about the iron core 42. The first coil 43 is accompanied with leads 45 which are bundled together to form a cord such as the cord 25 used in the first embodiment. This coil 43 is used for receiver application. The second coil 44 is accompanied with leads 46 which are bundled together to form a cord such as the cord 35 used in the first embodiment, this coil 44 is used for microphone application.

The earphone set of the above-described construction operates in two fashions as follows.

First, the earphone set 1 operates as a microphone, when human voices are introduced into the housing 10 via the air socket 12, the vibratory membrane 21 of the vibration unit 20 is driven for corresponding vibrations. This vibration causes corresponding variation in the magnetic fluxes in the iron core 42. In accordance with this variation in magnetic fluxes, the second coil 44 generates corresponding electric acoustic signals which are in turn transmitted to a proper outside sound system via the leads 46.

Next, the earphone set 1 operates as receiver. In this case, electric acoustic signals are transmitted to the conversion unit 40 from a proper outside system via the leads 45. On receipt of the electric acoustic signals, the first coil 48 varies magnetic fluxes in the iron core 42 to cause corresponding change in the magnetic field. Depending on the change in the magnetic field, the vibratory membrane 21 of the vibration unit 20 vibrates at frequencies corresponding change in the magnetic field to generate voices corresponding to the electric acoustic signals received at the conversion unit 40.

Figure 4:
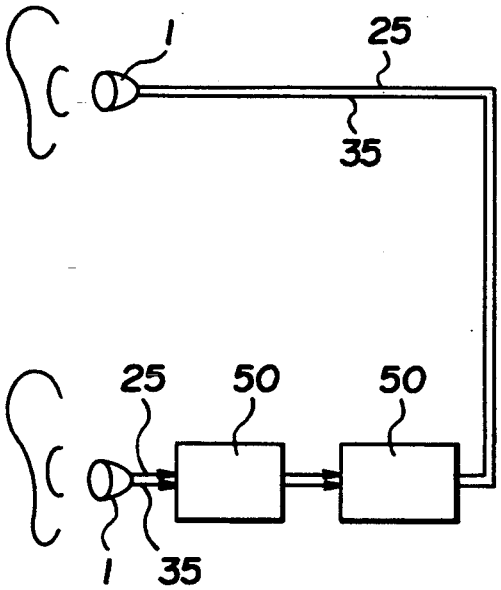
FIG. 4 is a block diagram of an electroacoustic system using the earphone set of the present invention.

In actual use of the earphone set 1 in accordance with the present invention, proper amplifiers 50 may be inserted into the electric circuit as shown in FIG. 4.

The earphone set in accordance with the present invention is bifunctional and, as such, suitable for duplex operation. Stated otherwise, two different circuits, i.e. a microphone circuit and a receiver circuit, are contained in a single set and possible interference between the different functional circuit may incur a problem of howling in sound generation. Such a trouble may be easily overcome by incorporating a proper IC circuit into the construction of the earphone set.

In accordance with the present invention, a single earphone set can be simultaneously used as a microphone as well as a receiver.

We claim:

1. A bifunctional earphone set comprising:

a) a housing provided with an ear socket adapted to be inserted into the ear canal of a user thereof;

b) a vibratory membrane disposed within said housing generally perpendicular to the longitudinal axis of said ear socket having a first planar side facing said ear socket and electrically connected to a signal output terminal;

c) a ceramic wafer attached face to face to said vibratory membrane on said first planar side and electrically connected to said signal output terminal; and d) a magnetic electroacoustic conversion means arranged within said housing facing a second planar side of said vibratory membrane opposite to said first planar side including at least one coil electrically connected to a signal input terminal;

whereby said vibratory membrane reproduces human voices on receipt of corresponding electric acoustic signals to said signal output terminal and said ceramic wafer simultaneously issues electric acoustic signals on collection of corresponding human voices at said vibrating membrane.

2. A bifunctional earphone set as claimed in claim 1 in which said ceramic wafer is connected to an outside sound generating system via first conductive leads, and said magnetic electroacoustic conversion unit includes a permanent magnet, an iron core coupled to said permanent magnet, and a coil mounted to said iron core and connected to an outside electric signal reception system via second conductive leads.

3. A bifunctional earphone set as claimed in claim 1 in which said magnetic electroacoustic conversion unit includes a permanent magnet, an iron core coupled to said permanent magnet, first and second coils coaxially mounted to said iron core, said first coil is connected to an outside sound generating system via first conductive leads, and said second coil is connected to an outside electric signal reception system via second conductive leads.

* * * * *